US008002868B2

(12) United States Patent
Kim et al.

(10) Patent No.: US 8,002,868 B2
(45) Date of Patent: Aug. 23, 2011

(54) DEHUMIDIFIER

(75) Inventors: Moon Shin Kim, Changwon (KR); Sang Youn Yoon, Changwon (KR)

(73) Assignee: LG Electronics Inc., Seoul (KR)

( * ) Notice: Subject to any disclaimer, the term of this patent is extended or adjusted under 35 U.S.C. 154(b) by 483 days.

(21) Appl. No.: 12/084,283

(22) PCT Filed: Nov. 1, 2006

(86) PCT No.: PCT/KR2006/004502

§ 371 (c)(1),
(2), (4) Date: Feb. 4, 2009

(87) PCT Pub. No.: WO2007/052946

PCT Pub. Date: May 10, 2007

(65) Prior Publication Data

US 2009/0158935 A1 Jun. 25, 2009

(30) Foreign Application Priority Data

Nov. 1, 2005 (KR) ..... 10-2005-0103872
Jan. 9, 2006 (KR) ..... 10-2006-0002241

(51) Int. Cl.
*B01D 45/00* (2006.01)

(52) U.S. Cl. ..... 55/481; 55/480; 55/478; 55/493; 55/506; 55/498; 55/482.1; 55/490.2; 55/490; 165/138

(58) Field of Classification Search ..... 55/481, 55/480, 478, 493, 506, 498, 482.1, 490.2, 55/490; 165/138
See application file for complete search history.

(56) References Cited

U.S. PATENT DOCUMENTS

| | | | | |
|---|---|---|---|---|
| 3,306,069 | A * | 2/1967 | Wegman | 62/262 |
| 6,354,936 | B1 * | 3/2002 | Noh et al. | 454/201 |
| 6,949,131 | B2 * | 9/2005 | Yeung | 55/467.1 |
| 7,147,685 | B2 * | 12/2006 | Lee | 55/467 |
| 7,481,869 | B2 * | 1/2009 | Vanderhoof et al. | 96/4 |
| 7,670,414 | B2 * | 3/2010 | Cha et al. | 96/398 |
| 7,833,299 | B2 * | 11/2010 | Dawson et al. | 55/385.2 |
| 2005/0204713 | A1 | 9/2005 | Wu et al. | |
| 2008/0156465 | A1 * | 7/2008 | Weidmann | 165/138 |

FOREIGN PATENT DOCUMENTS

| | | | |
|---|---|---|---|
| EP | 0769664 | A2 | 4/1997 |
| EP | 0947781 | A1 | 10/1999 |
| JP | 60-172363 | | 9/1985 |

* cited by examiner

*Primary Examiner* — Jason M Greene
*Assistant Examiner* — Dung Bui
(74) *Attorney, Agent, or Firm* — McKenna Long & Aldridge LLP

(57) ABSTRACT

A dehumidifier is provided. The dehumidifier includes a cabinet defining an outer appearance of the dehumidifier and having an air inlet and an air outlet, and a filter assembly disposed in the cabinet and purifying air introduced through the air inlet, wherein the filter assembly comprises a filter frame and a filter case coupled to the filter frame by a hinge and being capable of pivoting frontward.

16 Claims, 12 Drawing Sheets

[Fig. 1]
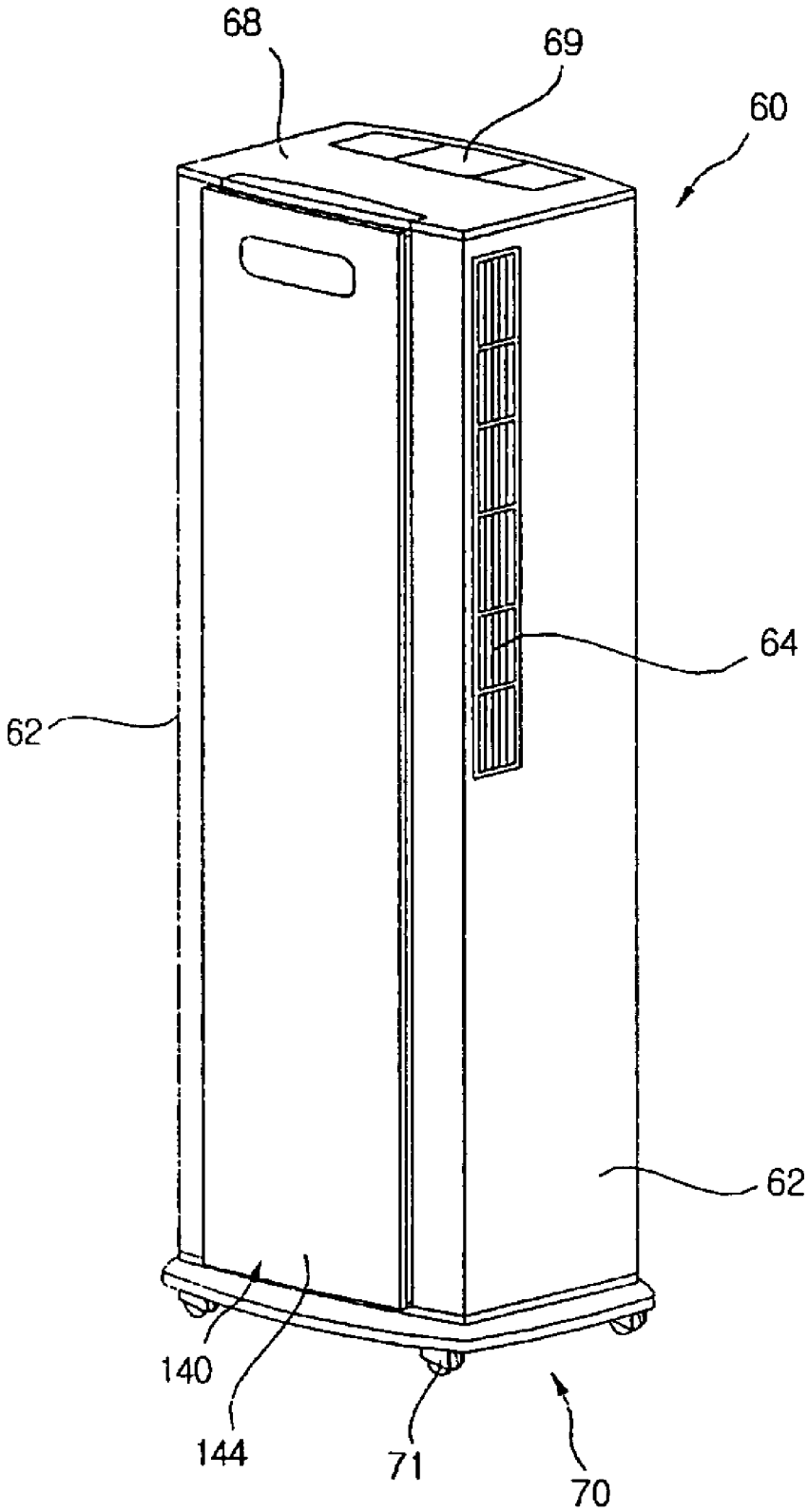

[Fig. 2]
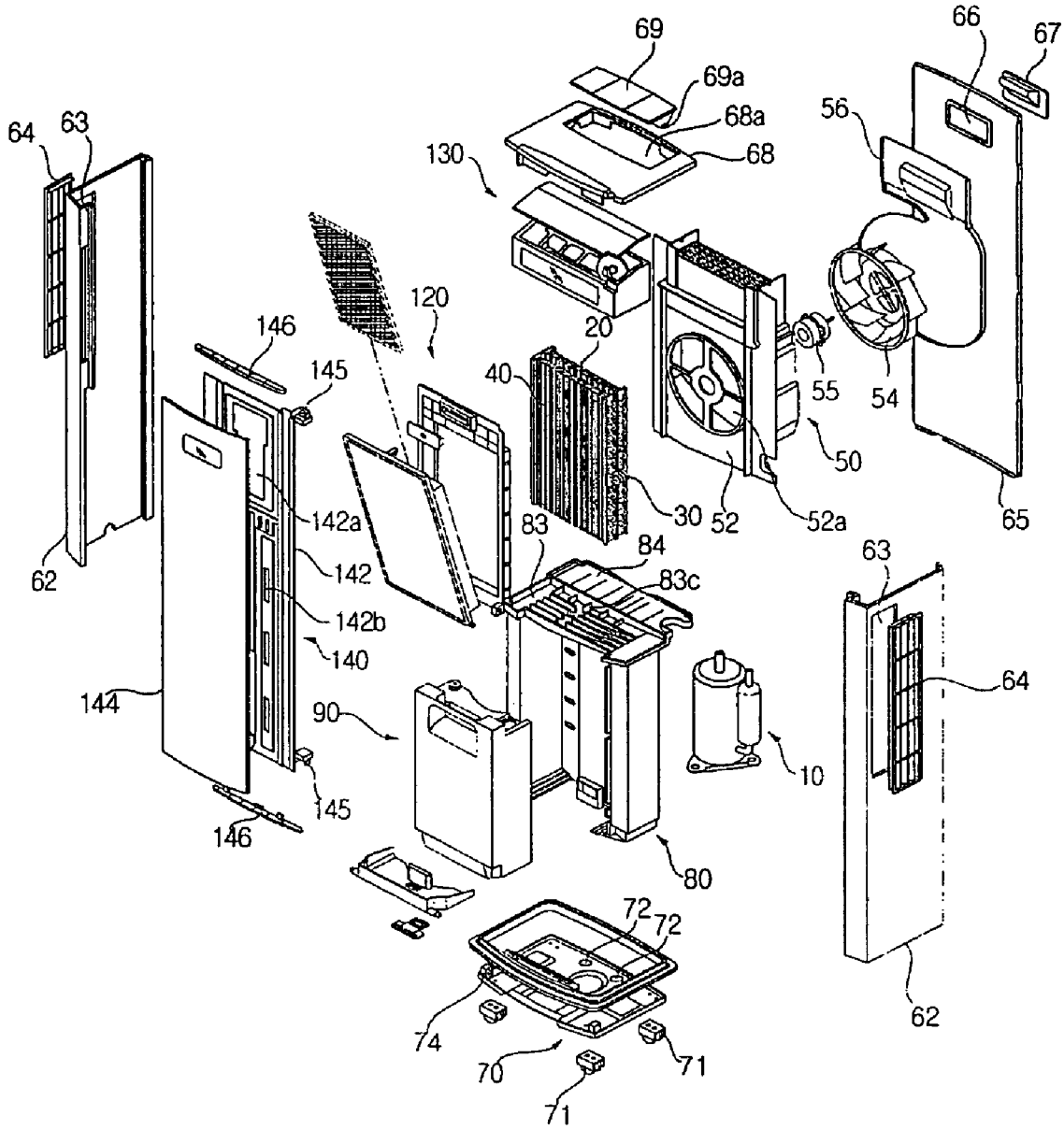

[Fig. 3]
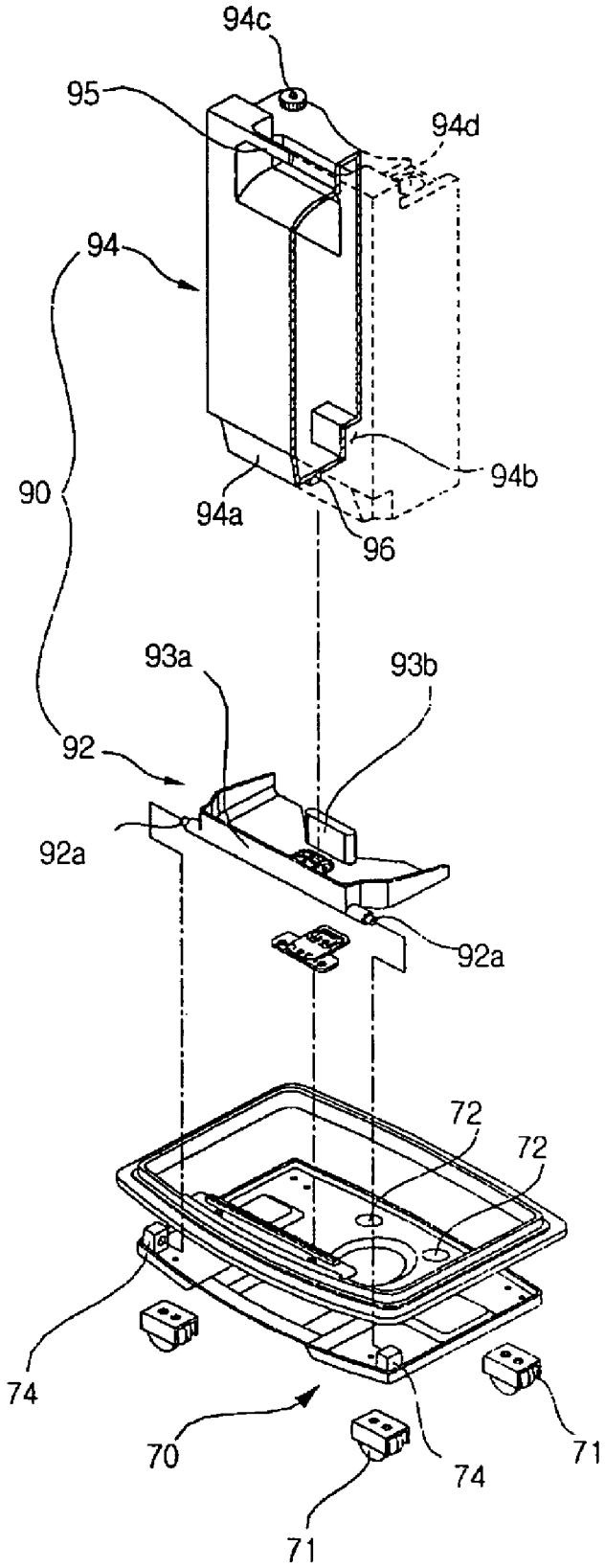

[Fig. 4]
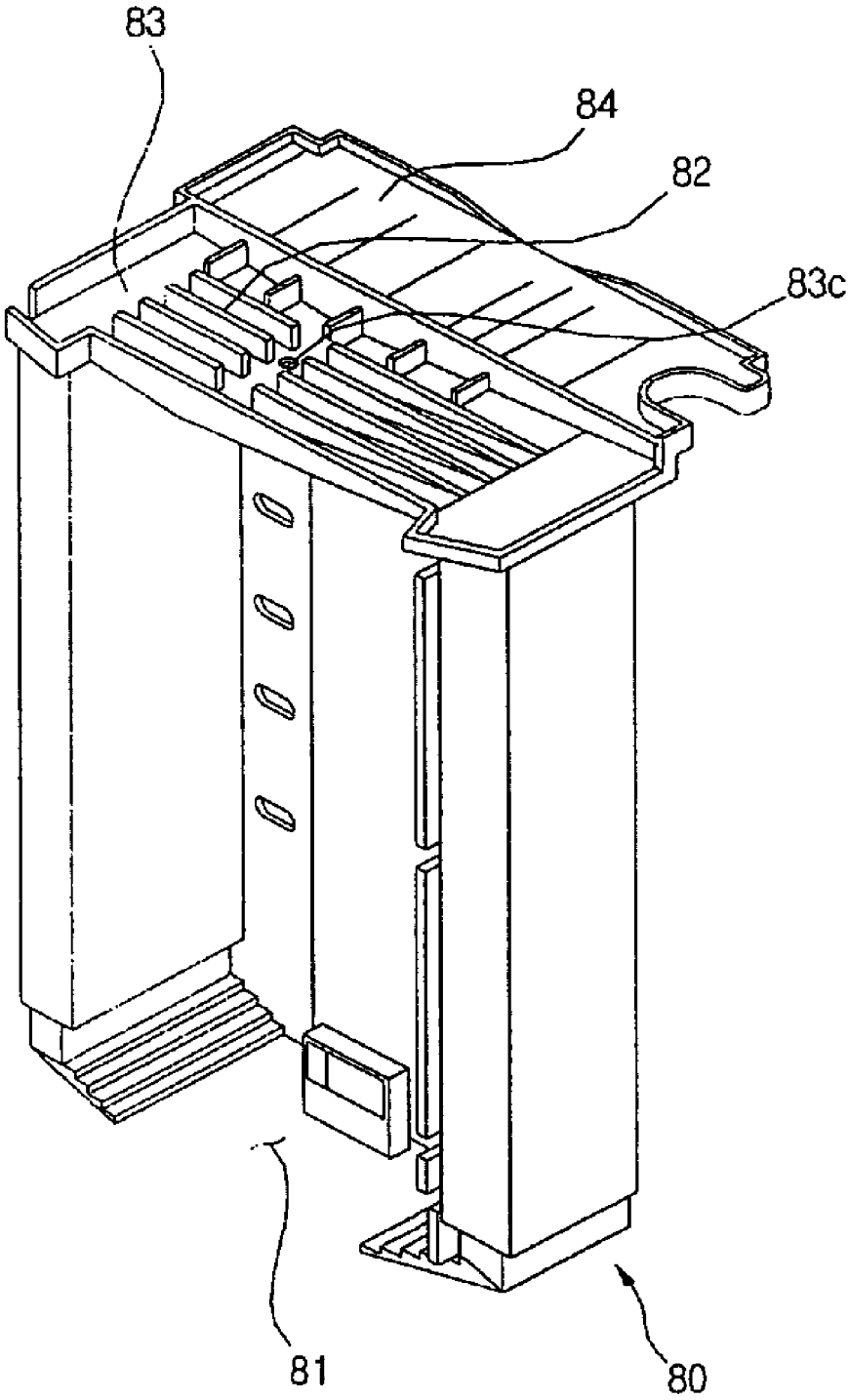

[Fig. 5]
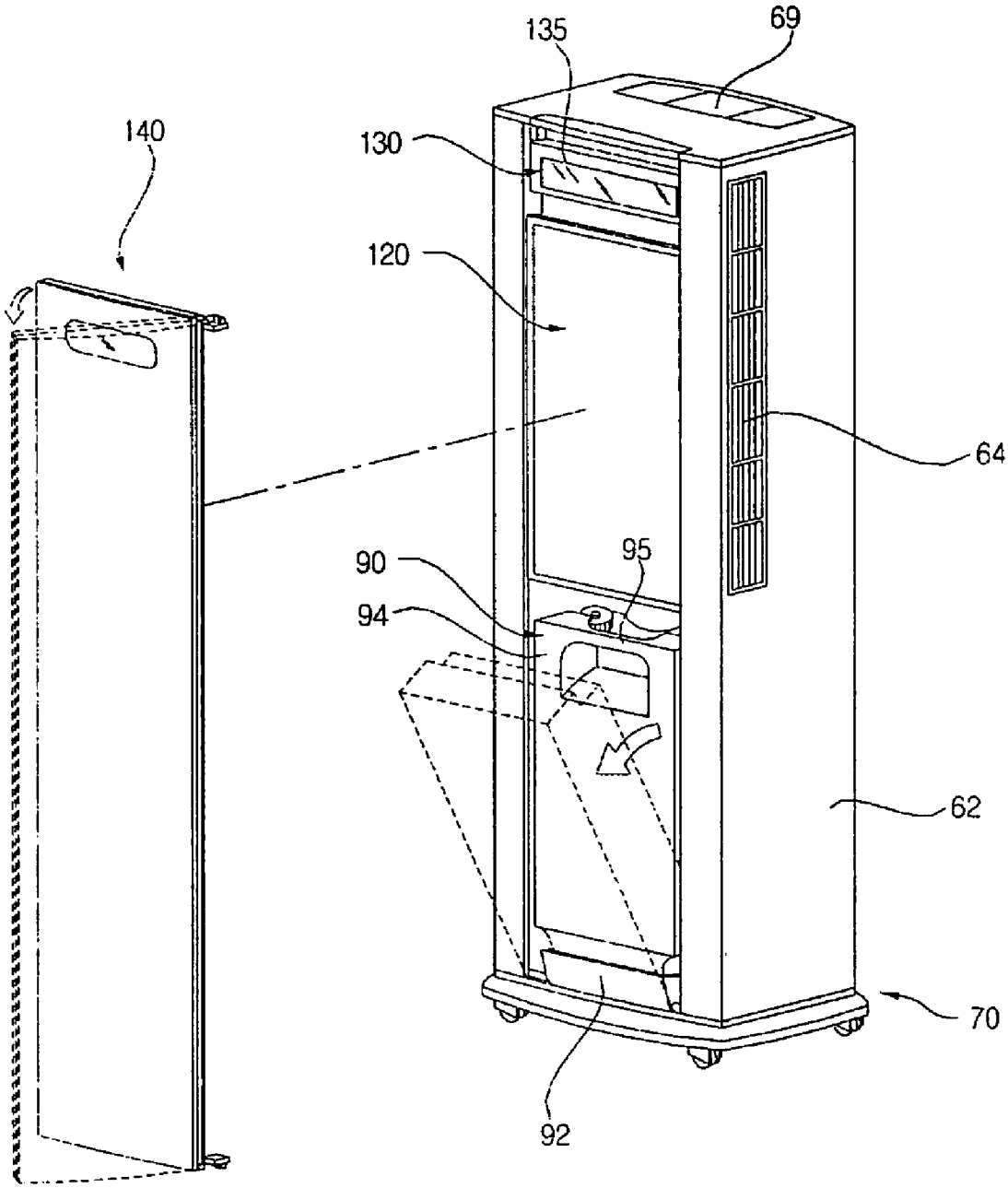

[Fig. 6]
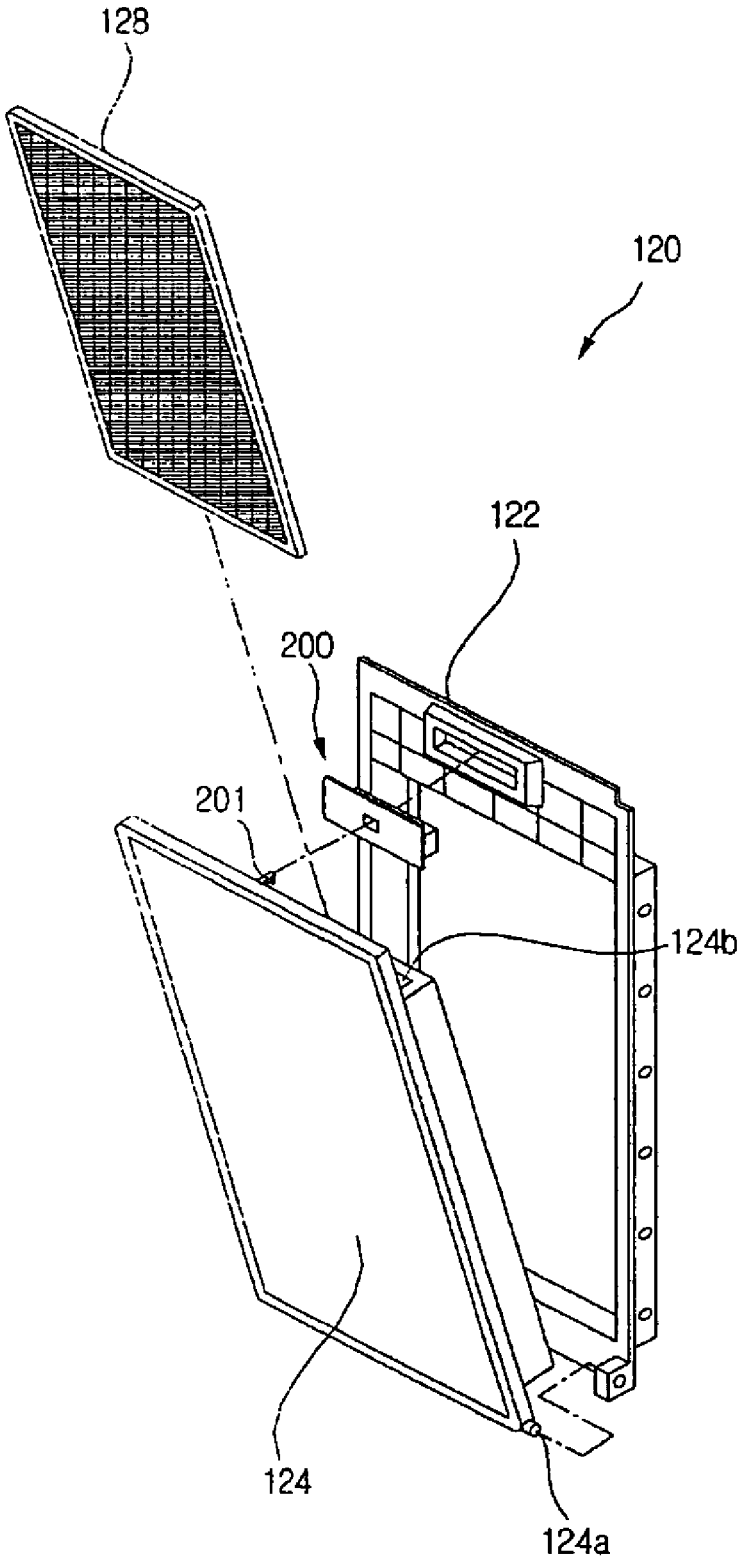

[Fig. 7]
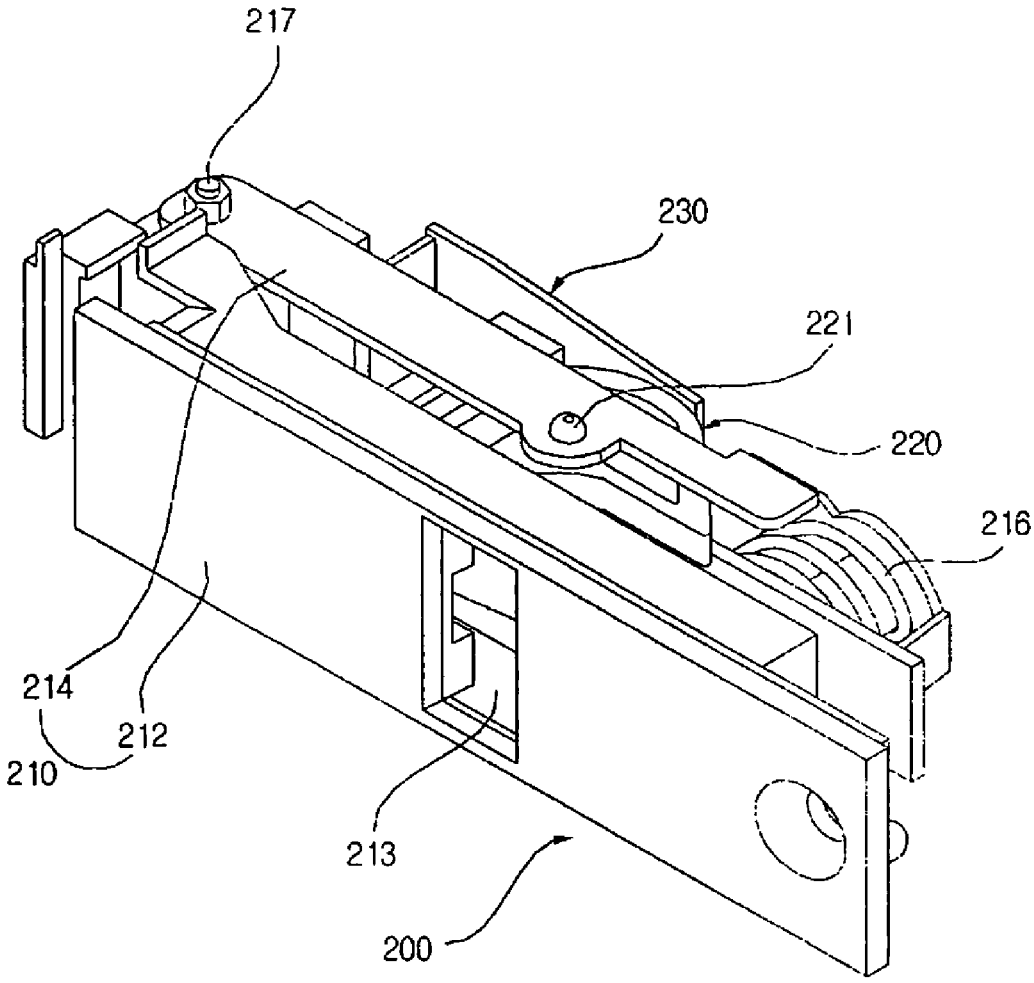

[Fig. 8]
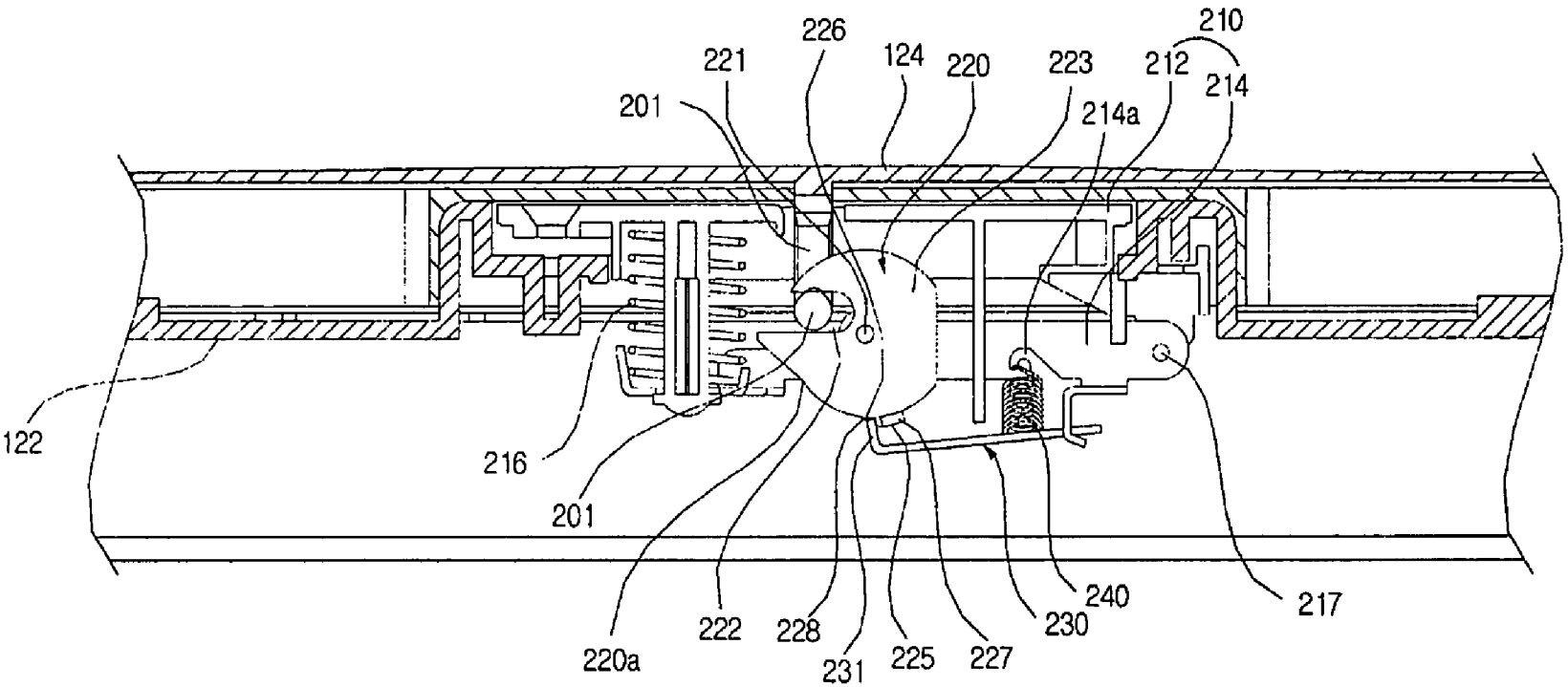

[Fig. 9]
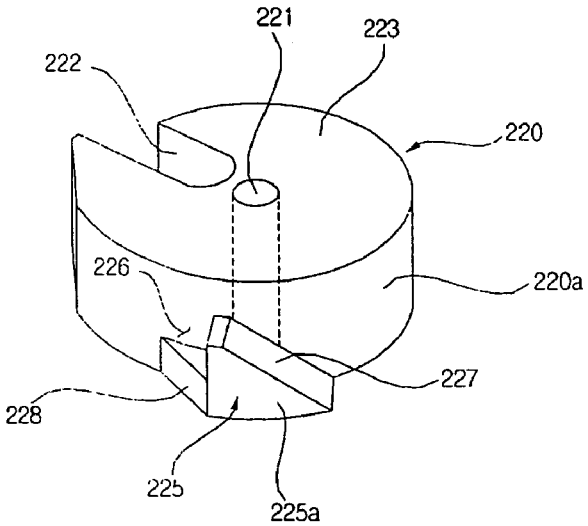
[Fig. 10]
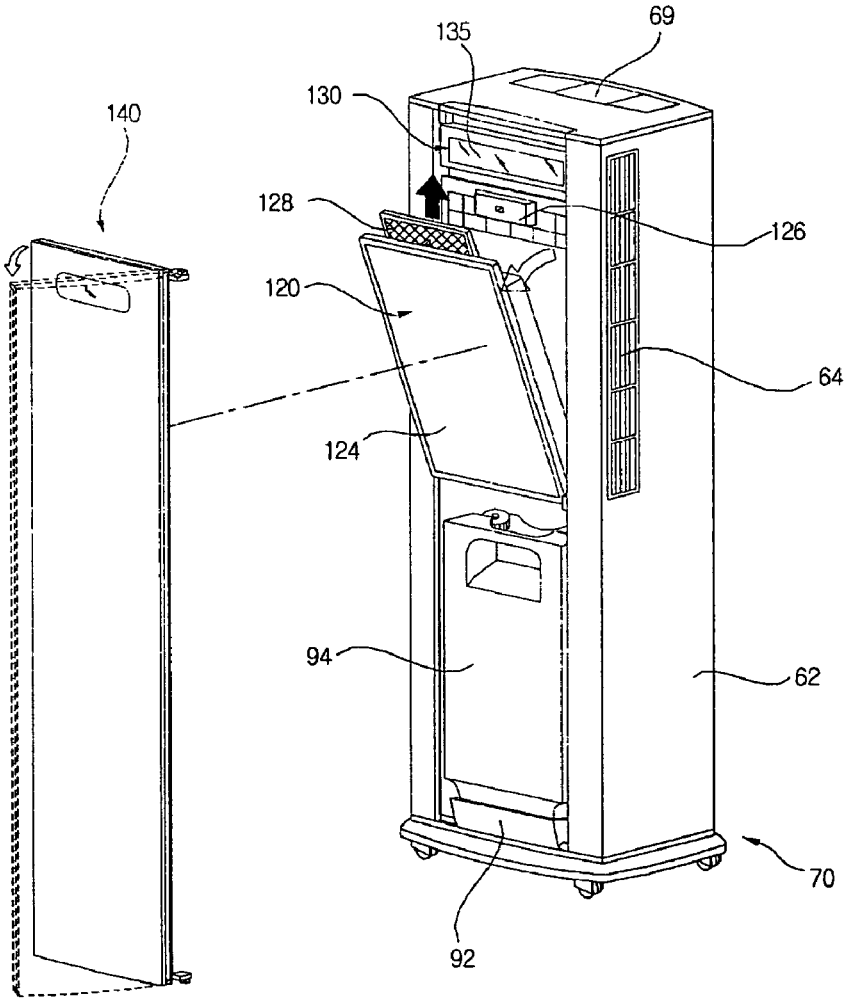

[Fig. 11]
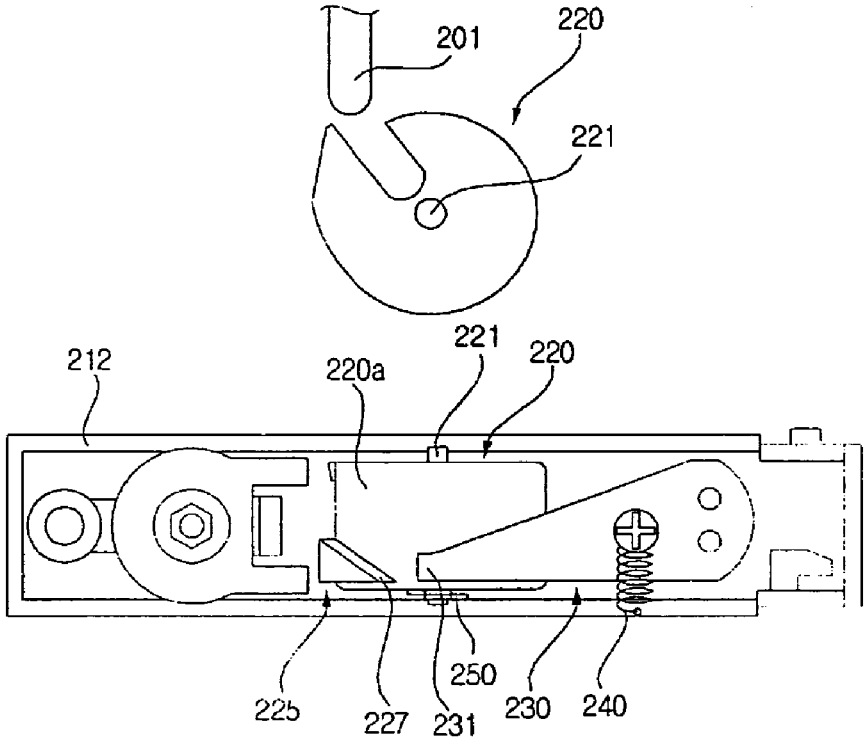
[Fig. 12]
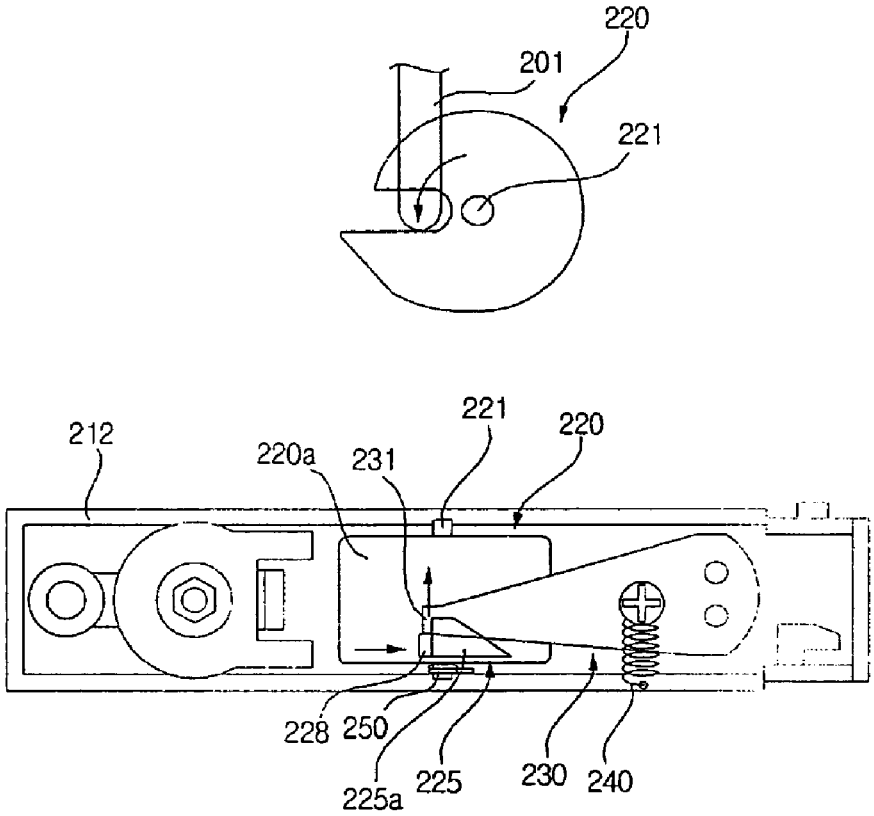

[Fig. 13]
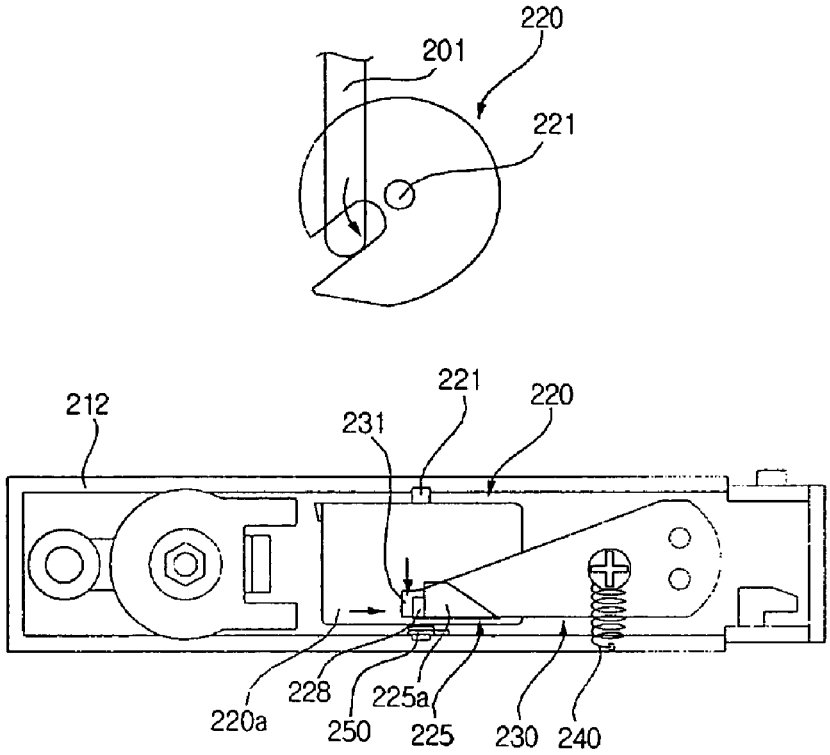
[Fig. 14]
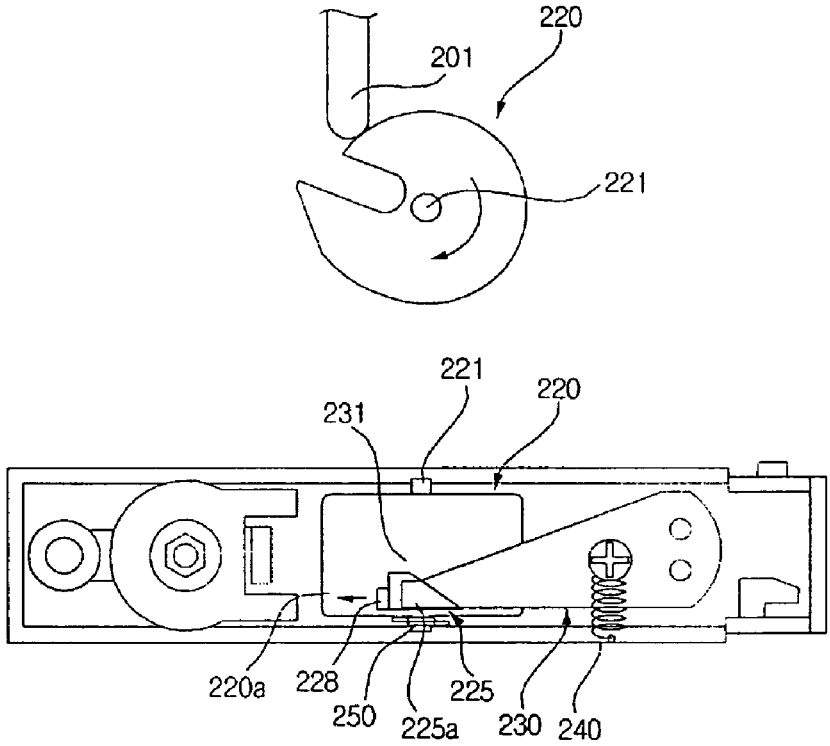

[Fig. 15]
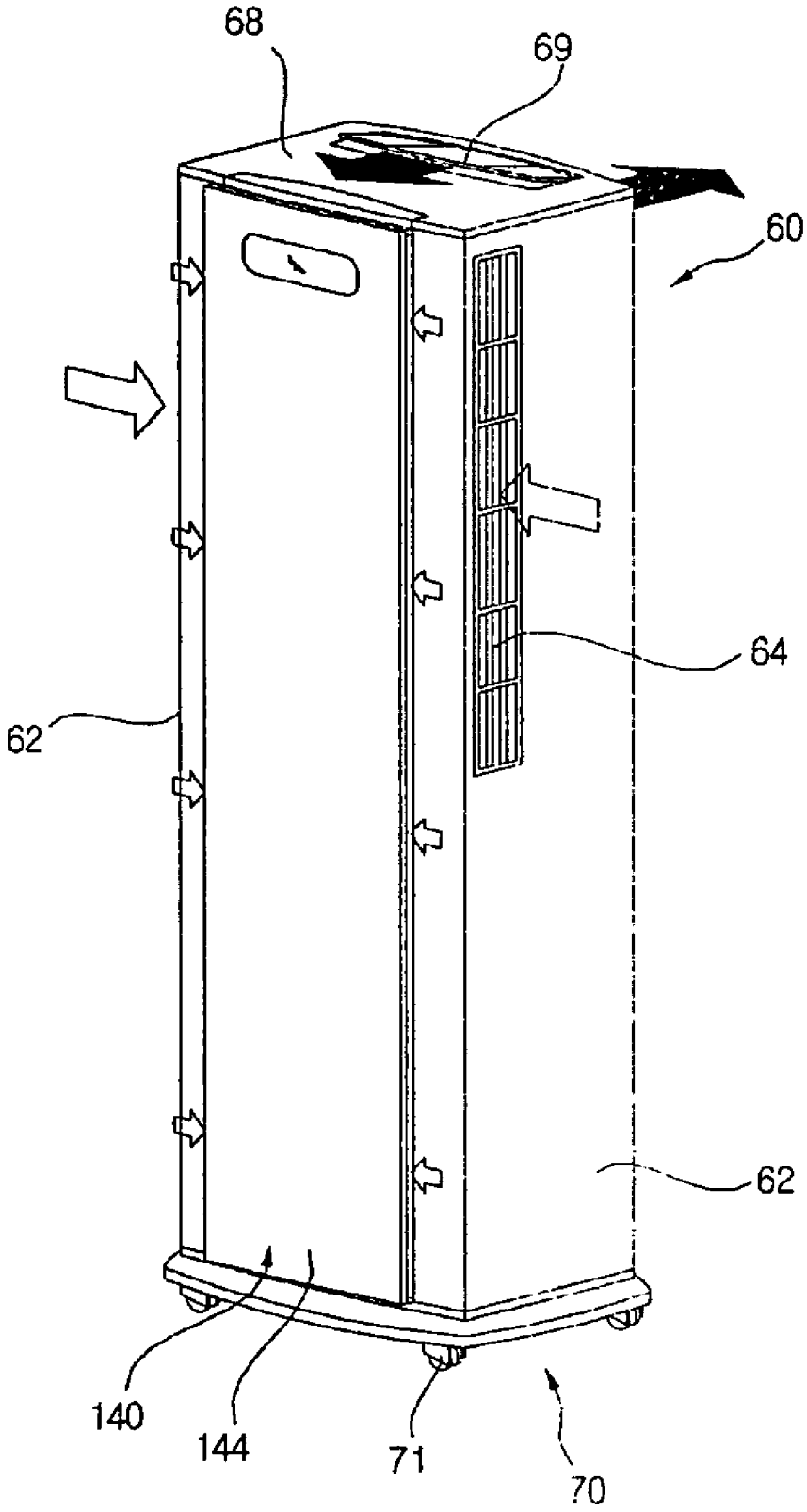

DEHUMIDIFIER

This application claims benefit of PCT Patent Application No. PCT/KR2006/004502, filed Nov. 1, 2006, which claims benefit of Korean Patent Application No. 10-2005-0103872, filed Jan. 11, 2005 and Korean Patent Application No. 10-2006-0002241, filed Jan. 9, 2006, which are all hereby incorporated by reference in their entirety.

TECHNICAL FIELD

The present invention relates to a dehumidifier, and more particularly, to a de-humidifier having a filter for purifying air introduced into the dehumidifier, which can be easily mounted and separated.

BACKGROUND ART

Generally, a dehumidifier is an apparatus for sucking humid indoor air into a cabinet, removing moisture from the humid air by allowing the humid air to pass through a heat exchanger having a condenser and a vaporizer along which refrigerants flow, then discharging the air from which the moisture is removed to an indoor room.

The humidifier includes a cabinet defining an outer appearance, a compressor installed in the cabinet and compressing refrigerants, a condenser for condensing the refrigerants compressed by the compressor by heat-exchanging the refrigerants with air, an expansion valve for expanding refrigerants condensed by the condenser, a vaporizer for vaporizing the refrigerants expanded by the expansion valve by heat-exchanging the refrigerants with air, a blower fan for forcedly directing the air into the cabinet, a drain pan for collecting the condensed water generated during dehydrating, a bucket for storing the condensed water collected in the drain pan, and a filter for purifying the air introduced through an air inlet.

With the above structure of the conventional dehumidifier, when the blower fan operates, the indoor air is sucked into the cabinet. The sucked air passes through the vaporizer. Then, the moisture contained in the air is condensed on a surface of the vaporizer, thereby removing the moisture from the indoor air. Then, the air whose moisture is removed is discharged out of the cabinet. During this process, the condenser water is stored in a bucket disposed in the cabinet and the user periodically empties the bucket.

However, in order to separate the filter from the dehumidifier, the cabinet must be disassembled and, when the filter is coupled by coupling members such as screws, the coupling members must be released. This makes it troublesome to mount and separate the filter.

DISCLOSURE OF INVENTION

Technical Problem

Accordingly, the present invention is directed to a dehumidifier that substantially obviates one or more problems due to limitations and disadvantages of the related art.

An object of the present invention is to provide a dehumidifier that can make it easy to mount and separate a filter by pivotally mounting a filter case in which the filter is mounted and a filter frame connected to a heat exchanger using hinges.

Another object of the present invention is to provide a dehumidifier that can allow the user to separate or mount the filter case and the filter frame by a stroke of action.

Still another object of the present invention is to provide a humidifier that can minimize the damage of the filter during the replacement of the filter.

Technical Solution

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a de-humidifier including: a cabinet defining an outer appearance of the dehumidifier and having an air inlet and an air outlet; and a filter assembly disposed in the cabinet and purifying air introduced through the air inlet, wherein the filter assembly comprises a filter frame and a filter case coupled to the filter frame by a hinge and being capable of pivoting frontward.

According to another aspect of the present invention, there is provided a de-humidifier including: a cabinet provided with an air inlet and an air outlet; a filter frame fixed in the cabinet; a filter case coupled to the filter frame; a filter received in the filter case to purify air introduced thrugh the air inlet; a fixing mechanism for fixing the filter frame to the filter case; and a fixing hook performing a hook operation with the fixing mechanism.

According to still another aspect of the present invention, there is provided a de-humidifier including: a cabinet provided with an air inlet and an air outlet; a front panel assembly defining an outer appearance of the cabinet and pivoting frontward of the cabinet; a filter for purifying air introduced through the air inlet; a filter case for receiving the filter; a filter frame to which the filter case is pivotally coupled; and a mounting/dismounting mechanism for coupling or separating the filter case to or from the filter frame.

ADVANTAGEOUS EFFECTS

According to the dehumidifier of the above aspects, since the front panel assembly is opened and closed in a hinged door type and the filter case on which the filter is mounted using a sliding type is coupled to the filter frame connected to the heat exchanger by a hinge, the mounting and separation of the filter can be realized through a simple manual operation.

In addition, since the filter case is provided with a sliding guide so that the filter can be mounted through the sliding motion, the impact that may be applied to the filter during the mounting and separation process may be lowered as compared with a case where the filter is coupled by fasteners such as screws.

Furthermore, since the coupling and separation of the filter case is realized through a one-touch manner using a fixing mechanism, it is convenient to use the same.

In addition, since the hook of the filter case is hooked and fixed on the cam of the filter frame, the filter case can be securely fixed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a perspective view of a dehumidifier according to an embodiment of the present invention;

FIG. 2 is an exploded perspective view of the dehumidifier of FIG. 1;

FIG. 3 is an exploded perspective view of a bucket assembly according to an embodiment of the present invention;

FIG. 4 is a perspective view of a barrier according to an embodiment of the present invention;

FIG. 5 is a view illustrating a separating process of the bucket assembly according to an embodiment of the present invention;

FIG. 6 is an exploded perspective view of a filter assembly according to an embodiment of the present invention;

FIG. 7 is a perspective view of a fixing mechanism of the filter assembly;

FIG. 8 is a sectional view of the fixing mechanism;

FIG. 9 is a perspective view of a cam of the fixing mechanism;

FIG. 10 is a view illustrating a separating process of the filter assembly;

FIG. 11 is a view illustrating a state before the fixing mechanism is operated;

FIG. 12 is a view illustrating an operation state of the fixing mechanism;

FIG. 13 is a view illustrating a hook state of the fixing mechanism;

FIG. 14 is a view illustrating a hook release state of the fixing mechanism; and FIG. 15 is a view illustrating an operation of the dehumidifier of the present invention.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

FIG. 1 is a perspective view of a dehumidifier according to an embodiment of the present invention and FIG. 2 is an exploded perspective view of the dehumidifier of FIG. 1.

Referring to FIGS. 1 and 2, a humidifier of the present invention includes a cabinet 60 defining an outer appearance, a compressor 10 installed in the cabinet 60 and compressing refrigerants, a condenser 20 for condensing the refrigerants compressed by the compressor by heat-exchanging the refrigerants with air, an expansion valve 30 for expanding refrigerants condensed by the condenser 20, and a vaporizer 40 for vaporizing the refrigerants expanded by the expansion valve 30 by heat-exchanging the refrigerants with air, and a blower fan assembly 50 for forcedly directing the air into the cabinet.

The dehumidifier of the present invention further includes a base 70 formed a bottom of the cabinet 60, a barrier 80 vertically installed on the base 70 and dividing the base into front and rear portions, a bucket assembly 90 installed on the barrier 80 to store the condensed water condensed on a surface of the vaporizer, and a filter assembly installed on an upper portion of the barrier 80 to filtering off foreign off foreign objects contained in air introduced into the cabinet 60 and directed to the blower fan assembly 50.

Describing in more detail, wheels 71 are installed on a bottom of the base 70 and the barrier 80 is installed on the base 70. With reference to the barrier 80, the bucket assembly 90 is installed on the front portion of the base 70 and the compressor 10 is installed on the rear portion of the base 70.

In addition, the filter assembly, vaporizer 40, condenser 20, and blower fan assembly 50 are installed on the barrier 80 from the front portion to the rear portion in this order.

Here, the vaporizer 40 and the condenser 20 are spaced apart from each other and integrally coupled to each other. In order for the condensed water condensed by the vaporizer 40 to be effectively collected at the barrier 80, a drain pan 83 is formed on a top surface of the barrier 80. The vaporizer 40 and the condenser 20 are mounted on the drain pan 83.

Furthermore, an installation unit 84 formed at a higher location that the drain pan 83 is formed on the top surface of the barrier 80 and the blower fan assembly 50 is mounted on the installation unit 84.

The blower fan assembly 50 includes a housing 52 installed on the barrier 80, a centrifugal pan 54 installed in the housing 52, a driving motor 55 for driving the centrifugal pan 54, and a housing cover 56 assembled with the housing g52 to guide air discharged from the centrifugal pan 54.

The housing 52 is provided with an air inlet 52*a* through which the air is sucked. The air accelerated by the centrifugal pan 54 after passing through the air inlet 52*a* is guided upward by the housing 52 and the housing cover 56.

The housing 52 divides an interior of the cabinet into front and rear portions so that the air introduced from the interior room can be directed to the centrifugal pan 54 through only an air inlet 52*a*.

Furthermore, the vaporizer/condenser 40/20 and the housing 52 are assembled with each other, and a control box 130 for controlling the humidifier is installed above the vaporizer/condenser 40/50 and the housing 5.

Meanwhile, the cabinet 62 includes a side panel 62 defining a side appearance, a rear panel 65 defining a rear appearance, a top panel 68 defining a top appearance, and a front panel assembly 140 defining a front appearance.

That is, the side panel 62, rear panel 65, and front panel assembly 140 are vertically installed on a top surface of the base 70

The side panel 62 is provided with an inlet through which the air is introduced. The rear and front panels 65 and 68 are provided with respective air outlet 66 and 68*a* through which the air is discharged.

A louver 64 for controlling an induction direction of the air is installed in the inlet 63 of the side panel 62 and louvers 67 and 69 for controlling a discharging direction of the air are installed in the respective outlets 66 and 68*a* of the top panel 68.

Here, the louvers 64 and 67 installed on the respective side and rear panels 62 and 66 are designed to be adjusted by a user. The louver 69 installed on the panel 68 is designed to be controlled by a controller or the user.

At this point, the louver 69 is connected to the top panel 68 by a fin 69*a* so that it can pivot upward and downward. A motor (not shown) or a power transmission mechanism (not shown) may be installed on the top panel 67 so that the louver 69 can pivot by the control unit.

Meanwhile, the front panel assembly 140 includes a front frame 142 connected to the side panel 62 to pivot frontward, and a front panel 144 installed on a front surface of the front frame 142 so that it can be exposed to the user.

The peripheries of the front panel 144 and the front frame 142 are spaced apart by a predetermined distance. Therefore, the indoor air can be introduced into the cabinet 60 through a gap formed between the peripheries of the front panel 144 and the front frame 142.

A panel guide 146 is interposed between the front panel 144 and the front frame 142 at upper and lower ends.

In order for the air flows toward the filter assembly disposed in rear of the front frame 142, the front frame 142 is provided with a plurality of holes 142*a* and slits 142*b*.

Furthermore, a bracket 145 is installed on an edge of the front frame 142 so that the front frame 142 can be connected to the side panel 62 by a hinge. The bracket 145 is formed at each of upper and lower ends of the side edge of the side panel 62 so that the front panel assembly 140 can be opened and closed in a hinge motion.

The following will describe the bucket assembly 90 according to an embodiment of the present invention.

FIG. 3 is an exploded perspective view of the bucket assembly.

Referring to FIG. 3, the bucket assembly 90 of this embodiment includes a bucket guide 92 hingedly connected to the base 70 to pivot frontward and a bucket 94 storing the condensed water and pivoting frontward together with the bucket guide 92.

That is, a pin-shaped hinge 92*a* protrudes from both ends of the bucket guide 92 and is coupled to the bracket 74 of the base 70. Therefore, the bucket guide 92 can pivot about the hinge 92*a*.

The bucket guide 92 includes first and second guide units 93*a* and 93*b* protruding upward to guide the accurate seating of the bucket 94.

Here, the first guide unit 93*a* is aligned with a groove 94*a* formed on a front-lower end of the bucket 94 and the second guide unit 93*b* is aligned with a groove 94*b* formed on a rear surface of the bucket 94.

The guide units 93*a* and 93*b* allows a water collecting hole (83*c* of FIG. 5) of the barrier 80 to be accurately aligned with an inflow hole 94*c* of the bucket 94.

In addition, a handle 95 is formed on an upper end of the bucket 94 so that the user uses the handle 95 when he/she intends to lift the bucket 94.

Therefore, when the user pulls frontward the handle 95 of the bucket 94, an upper end of the bucket 92*a* is pivoted frontward about the hinge 92*a*. Then, after the upper end of the bucket 94 moves out of a receiving portion (81 of FIG. 5) of the barrier 80, the user lifts the bucket 94 so that the bucket 94 can be completely separated from the bucket guide 92.

Here, although now shown in the drawing, the bucket guide 92 may be installed to be hingedly coupled to the barrier.

FIG. 4 is a perspective view of the barrier of the present invention.

Referring to FIG. 4, the barrier 80 of this embodiment includes a receiving portion 81 for receiving the bucket assembly 90, a drain pan 83 formed on an upper portion to collect the condensed water, an installation portion 84 formed in rear of the drain pan 83 to support the blower fan assembly 50.

That is, a water collection hole 83*c* through which the condensed water collected in the drain pan 83 is directed to the inflow hole 94*c* of the bucket 94. Here, the water collection hole 83*c* is formed at a location corresponding to the inflow hole 94*c* of the bucket 83.

FIG. 5 is an operational view illustrating a separating process of the bucket assembly.

Referring to FIG. 5, the user opens the front panel assembly 140 to empty the bucket 94 storing the condensed water. Then, the front panel assembly 140 rotates about the bracket 145 of the side panel 62 to open the cabinet 60.

In addition, the user pulls the handle 95 of the bucket 94 to separate the bucket 94 from the barrier 80.

That is, since the bucket 94 is disposed on the bucket guide 92 and the bucket guide 92 rotates in a state where the hinge 92*a* is connected to the barrier 80, the upper end of the bucket 94 pivots frontward by the user pulling the bucket 94.

As described above, as the user pulls the handle 95 of the bucket 94, the upper end of the bucket 94 is partly removed out of the barrier 80 to a location where the user can effectively lift the bucket 94. That is, when the user lifts the handle 95, the lower end of the bucket 94 is separated from the bucket guide 92.

Therefore, since the bucket 94 can be separated by the user grasping the handle at once, the separation of the bucket 94 can be conveniently realized.

Meanwhile, since the assembling of the bucket 94 is done in a reverse order, the detailed description thereof will be omitted herein.

The following will describe the filter assembly.

FIG. 6 is an exploded perspective view of the filter assembly.

Referring to FIG. 6, the filter assembly 120 of this embodiment includes a filter frame 122 assembled on the vaporizer 40, a filter case 124 coupled to the filter frame and being capable of pivoting frontward, and a mounting/dismount mechanism for fixing the filter case 124 to the filter frame 122.

A filter 128 for filtering off foreign objects contained in the air introduced into the humidifier is slidably installed in the filter case 124. The filter case 124 is pivotally assembled on a lower end of the filter frame 122.

The lower end of the filter case 124 is connected to the lower end of the filter frame 122 by a hinge 124*a*. The filter case 124 is opened while pivoting frontward about the hinge 124*a*.

Here, an elastic member such as a torsion spring is installed on the hinge 124*a* so that the filter case 124 pivots forward when the filter case 124 is separated from the filter frame 122.

Meanwhile, the mounting/dismounting mechanism includes a fixing mechanism 200 installed on the filter frame 122 and a hook 201 provided on an upper end of the filter case 124 and corresponding to the fixing mechanism 200.

Here, the hook 201 is hooked and fixed on the fixing mechanism 200 to fix the filter case 124 to the filter frame 122. This hooking of the hook 201 on the fixing mechanism 200 can be realized through a one-though manner.

The following will describe the fixing member 200 in detail.

FIG. 7 is a perspective view of the fixing mechanism of the filter assembly, FIG. 8 is a sectional view of the fixing mechanism, and FIG. 9 is a perspective view of a cam of the fixing mechanism.

Referring to FIGS. 7 through 9, the fixing mechanism 200 of this embodiment is installed on the filer frame 122 to separate or couple the filter frame 122 from or to the filter case 124.

The fixing mechanism 200 includes a housing inserted in the filter frame 122, a lever 230 installed on the housing 210 and fixing the cam 220 through a hooking motion, and an elastic member 240 disposed between the lever 230 and the housing 210 and biasing the lever 230 toward the cam 220.

The housing 210 includes an outer housing 212 which is exposed to the filter frame 122 and in which the hook 201 is inserted, and an inner housing 214 which is inserted in the filter frame 122 and on which the cap 220 is installed.

Interposed between the outer and inner housings 212 and 214 is a spring 216 for maintaining a gap between the outer housing 212 and the inner housing 214.

Furthermore, the outer housing 212 is provided with a hole 213 in which the hook 201 is inserted. The hook 201 is hooked and fixed on the cap 220 over the hole 213.

One end of the outer housing 212 and one end of the inner housing 214 are connected to each other by a hinge 217 and the spring 216 is installed at an opposite side of the hinge 217.

Here, the inner housing 214 is installed and supported in the filter frame 122 and the outer housing 212 is biased frontward by the spring 216.

Therefore, even when a load or impact is applied to the outer housing 212, the outer housing 212 moves inward by the impact or load by a predetermined distance and is then biased again frontward by the spring 216.

Meanwhile, the lever 230 is installed in the inner housing 214 and is formed of an elastic material so that it can move frontward.

That is, an extreme end 231 of the lever 230 is bent frontward and moves along a guide unit 225 formed on an outer circumference of the cap 220. The extreme end 231 of the lever 230 is hooked and fixed on the hook end 226 formed on the guide portion 225.

Meanwhile, the elastic member 240 biases the lever 230 rearward. To realize this, the elastic member 240 connects the lever 230 to a rear end 214*a* of the inner housing 214.

Here, the elastic member 240 is inclined in a vertical direction between the inner housing 214 and the lever 230 so that component forces can be provided in frontward and downward directions against the elastic force applied to the lever 230. The frontward component force generated by the elastic member 240 biases the end 231 to the cam 220 and the downward component force biases the end 231 downward so that the cam 220 is biased to the guide portion 225.

Meanwhile, the cam 220 is rotatably mounted on the inner housing by a pin 221 inserted in a vertical direction and a torsion spring (250 of FIG. 11) is installed between the pin 221 and the cap 220 to provide rotational force to the cam 220.

The cap 220 includes a body 223 on which a hook groove 222 for fixing the hook 201 is formed, and a guide portion 225 formed on an outer circumference 220*a* of the body 223.

That is, the guide portion 225 protrudes from the outer circumference 220*a* of the body 223 in a radial direction and has a plurality of inclined surfaces for guiding the extreme end 231 of the lever 230.

Here, the guide unit 225 includes a hook fixing inclined surface 227 for moving the extreme end 231 of the lever 230 upward and fixing the same to the hook end 226, and a return inclined surface 228 for moving the extreme end 231 of the lever 230 from the hook end 226 to an initial position.

Particularly, the hook fixing inclined surface 227 contacts a lower end of the extreme end 231 to move the extreme end 231 of the lever 230 upward. In this embodiment, the hook fixing inclined surface 227 is inclined in an upward-downward direction.

The hook end 226 is defined by an inclined surface that is steeply inclined downward at an end portion of the hook fixing inclined surface 227 so that the extreme end 231 can be hooked on the hook end 226.

Meanwhile, the cap 220 rotates clockwise in the drawing by the torsion spring 250. The rotation of the cam 220 is limited as the hook end 226 is hooked on the extreme end of the lever 230.

Furthermore, the return inclined surface 228 is a surface for connecting the outer circumference 225*a* of the guide portion 225 to the outer circumference 220*a* of the cam 220 and is formed on a lower portion of the hook end 226.

Especially, the return inclined surface 228 connects the outer circumference 220*a* of the cap to the outer circumference 225*a* of the guide portion 225 so that the outer circumferences 220*a* and 225*a* become a continuous surface, thereby not being hooked on the extreme end 231.

Accordingly, when the cam 220 rotates counterclockwise such that the extreme end 231 moves from the hook end 226 to the return inclined surface 228, the fixing force of the cam 220 by the lever 230 is released.

Then, the cam 220 rotates clockwise by elastic force of the torsion spring 250 and the extreme end 231 moved from the hook end 226 to the return inclined surface 228 moves to its initial position while contacting the return inclined surface 228, the guide portion 225, and the outer circumference 220*a* of the cam 220.

Here, in this embodiment, although an example where the hook 201 is formed on the filter case 124 and the fixing mechanism 200 is formed on the filter frame 122 is illustrated, the hook 201 may be formed on the filter frame 122 and the fixing mechanism 200 is formed on the filter case 124.

The following will describe a separating process of the filter assembly 120 and an operation of the fixing mechanism 200.

FIG. 10 is a view illustrating a separating process of the filter assembly, FIG. 11 is a view illustrating a state before the fixing mechanism is operated, FIG. 12 is a view illustrating an operation state of the fixing mechanism, FIG. 13 is a view illustrating a hooked state of the fixing mechanism, and FIG. 14 is a view illustrating a hook release state of the fixing mechanism.

The separating and coupling of the filter assembly 120 will now be described with reference to FIG. 10.

The user opens the front panel assembly 140 and separates the filter case 124 from the filter frame 122.

In a state where the filter case 124 is coupled to the filter frame 122, an upper end of the filter case 124 is pressed. Then the hook 127 is pushed rearward of the fixing member 126 and returned to release the hook fixing state. Then, the filter 128 received in the filter case 124 gets out of the filter case 124.

Meanwhile, when it is intended to couple the filter assembly 120, the filter 128 is inserted in the filter case 124 through the sliding motion. Next, the upper end of the filter case 124 is pushed toward the filter frame 122. Then, the hook 127 is inserted into the fixing member 126 and then hooked and fixed while being pushed by a pre-determined distance frontward.

The operation of the fixing mechanism 200 will now be described with reference to FIGS. 11 through 14.

First, describing a process for fixing the hook 2301 formed on the filter case 124 on the fixing mechanism 200, the hook 201 contacts the cam 220 after passing through the hole 213 of the outer housing 212 and the hook 201 contacting the cam 220 is advanced into the hook groove 222 of the cam 220. Here, the hook groove 222 is formed in a diagonal direction with respect to the frontward side so that the cam 220 can be effectively rotate by the hook 201 inserted in the hook groove 220. The hook 201 is advanced toward the extreme end of the hook groove 222 that is diagonally arranged. In addition, when the hook 201 is advanced into the hook groove 222, the hook 201 pushes the cam 220.

Then, the cam 220 rotates counterclockwise by the hook 201 and thus the guide portion 225 of the cam 220 moves toward the lever 230.

In addition, when the hook fixing inclined surface 227 of the cam 220 contacts the extreme end 231 of the lever 230 the cam 220, the extreme end 231 moves upward by the hook fixing inclined surface 227. When the extreme end 231 goes over an upper end of the hook fixing inclined surface 227, the extreme end 231 is hooked on and supported by the hook end 226.

As described above, when the lever 230 is hooked and fixed on the hook end 226 of the cam 220, the hook 201 pushing the cam 220 is disposed inside the hook groove 222 and the hook groove 222 is disposed in a left-right direction, thereby preventing the hook 201 from being separated frontward.

The following will described the separating process of the fixing mechanism 200 and the hook 201.

In a state where the hook 201 is hooked on the hook groove 222 of the cam 220, when the user presses the filter case 124 on which the hook 201 is formed, the hook 201 is pushed and moved rearward by a predetermined distance and, by the rearward movement of the hook 201, the cam 220 further rotates counterclockwise by a pre-determined angle.

In addition, when the hook groove 222 of the cam 220 rotates furthermore rearward, the hook end 226 and the extreme end of the lever 230 are spaced apart from each other. When the hook end 226 further rotates to go over the lower end of the extreme end 231, the lever 230 moves downward by the elastic member 240.

That is, as the cam 220 further rotates, the hook state between the lever 230 and the cam 220 is released and thus the lever 230 hooked on the hook end 226 moves toward the return inclined surface 228. In addition, the extreme end 231 of the lever 230 is placed on the return inclined surface 228.

As described above, when the extreme end 231 is placed on the inclined surface 228, the lever 230 is not hooked 220. Then, the cam 220 rotates clockwise by the elastic force applied from the torsion spring 250 installed on the pin 221.

When the cam 220 rotates clockwise, the hook groove 222 of the cam 220 moves to an initial position and the hook 201 moves frontward without generating the interference with the hook groove 222. At this same time, the extreme end 231 of the lever 230 is returned to the initial position while contacting the return inclined surface 228, the outer circumference 225*a* of the guide portion 225, and the outer circumference 220*a* of the cam 220.

Meanwhile, when the interference between the hook 201 and the cam 220 is released, the filter case 124 and the torsion spring installed on the lower end hinge 124*a* of the filter frame 122 rotate the filter case 124 frontward by a predetermined angle.

Then, since the filter case 124 is opened toward the user and inclined toward the user, the user can easily remove the filter 128 out of the filter case 124.

As described above, the user can easily couple or separate the filter case 124 using the fixing mechanism 200 installed on the filter assembly 120 and thus the replacement of the filter 128 can be easily realized.

The following will describe the operation of the humidifier of this embodiment.

FIG. 15 is a view illustrating an operation of the dehumidifier of the present invention.

Referring to FIG. 15, when electric power is applied to the dehumidifier, the control unit installed in the control box 130 applies the power to the blower fan assembly 50 to introduce the indoor air into the cabinet 60 and discharge the introduced air to the room.

At this point, the indoor air is introduced through the air inlet 63 formed in the side panel 62, and the hole 142*a* and slit 142*b* formed in the front frame 142. The introduced air flows to the filter assembly 120 to filter off the foreign objects contained in the air.

Here, the foreign objects of the indoor air passing through the filter assembly 120 are filtered while the air passes through the filter 128. The air passing through the filter 128 is heat-exchanged with the vaporizer 40 after passing through the filter frame 122.

The filtered air heat-exchanges with discharge fins (not shown) formed on the vaporizer 40 and is thus cooled, in the course of which the moisture contained in the air is condensed on the surface of the vaporizer 40. The condensed water on the vaporizer 40 is collected in the drain pan 83 disposed on a lower portion of the vaporizer 40.

In addition, the air cooled while passing through the vaporizer is further heat-exchanged with the condenser 20 installed in rear of the vaporizer 40 to be heated again.

Here, since the condenser 20 emits heat during the condensing process of the vaporized refrigerants, the air from which the moisture is removed is heated to a temperature similar to that of the indoor air during the heat-exchanging process of the condenser 20.

After then, the air passing through the condenser 20 is guided to the housing 52 of the blower fan assembly 50. Then, the air guided into the housing 52 is accelerated by the centrifugal fan 54 installed in the housing 52 to be discharged to the room in a circumferential direction.

Here, the air discharge upward of the housing 52 is discharged to the room through the air outlet 69 formed on the top panel 68 and the air outlet 66 formed on the rear panel 65.

As described above, the dehumidifier of this embodiment sucks the air through the front and side surfaces and discharges the air through the top and rear surfaces. Therefore, the air can be directed in an every direction of the room in which the de-humidifier is installed.

Meanwhile, the control unit controls the air discharging direction and an amount of the air discharged by adjusting the rotational angle of the louver 69. Therefore, when the air is discharged upper-frontward of the cabinet 60, the louver 69 rotates rearward from the closed state to form the discharge hole frontward. When the air is discharged upper-rearward of the cabinet, the louver 69 rotates frontward from the closed state to form the discharge hole rearward.

Meanwhile, the condensed water condensed on the vaporizer 40 and collected in the drain fan 83 flows into the bucket 94 through the water collecting hole 83*c* of the drain pan 83. Since the separating process for separating the bucket 94 from the barrier 80 is described above, the detailed description thereof will be omitted herein.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

According to the dehumidifier of the present invention, since the filter frame is connected to the heat exchanger by a hinge, the mounting and separation of the filter can be realized through a simple manual operation. In addition, since the coupling and separation of the filter case is realized through a one-touch manner using a fixing mechanism, it is convenient to use the same. Therefore, the present invention is very liket to be applicable to the industry.

The invention claimed is:

1. A dehumidifier comprising:

a cabinet defining an outer appearance of the dehumidifier and having an air inlet and an air outlet;

a filter assembly disposed in the cabinet and purifying air introduced through the air inlet, wherein the filter assembly comprises a filter frame and a filter case coupled to the filter frame by a hinge and being capable of pivoting frontward; a fixing mechanism by which the filter case and the filter frame are hooked and fixed, wherein the fixing mechanism is formed on one of the filter case and the filter frame; and a hook formed on the other of the filter case and the filter frame, the hook being interlocked with the fixing mechanism, wherein the fixing mechanism comprises: a housing defining an outer appearance; a cam installed in the housing and rotating by a predetermined angle by an interference with the hook; a lever installed in the housing and hooking and fixing the cam rotating by the interference with the hook; and an elastic member disposed between the lever and the housing and biasing the lever toward the cam.

2. The dehumidifier according to claim 1, further comprising a heat exchanger for performing a heat exchanging operation, wherein the filter frame is fixed on the heat exchanger.

3. The dehumidifier according to claim 1, wherein the filter case is provided with a sliding guide on which the filter can be mounted in a sliding motion.

4. The dehumidifier according to claim 1, wherein lower portions of the filter case and the filter frame are coupled to each other by a hinge and an upper end of the filter case pivots frontward.

5. The dehumidifier according to claim 1, further comprising a front panel assembly rotatably coupled to a front surface of the cabinet.

6. The dehumidifier according to claim 5, wherein the front panel assembly comprises:

a front frame connected to the cabinet by a hinge and opening and closing the front of the cabinet through a hinge motion; and a front panel spaced apart from the front frame to define an air intake passage.

7. A dehumidifier comprising:

a cabinet provided with an air inlet and an air outlet;

a filter frame fixed in the cabinet;

a filter case coupled to the filter frame;

a filter received in the filter case to purify air introduced thrugh the air inlet;

a fixing mechanism for fixing the filter frame to the filter case; and a fixing hook performing a hook operation with the fixing mechanism, wherein the fixing mechanism comprises: a housing defining an outer appearance; a cam installed in the housing and rotating by a predetermined angle by an interference with the hook; a lever installed in the housing and hooked on the cam rotating by the interference with the hook; and an elastic member disposed between the lever and the housing and biasing the lever toward the cam.

8. The dehumidifier according to claim 7, wherein the filter case is provided with a sliding guide by which the filter is mounted through a sliding motion.

9. The dehumidifier according to claim 7, wherein lower portions of the filter case and the filter frame are coupled to each other by a hinge and upper portions of the filter case and the filter frame are coupled to each other by the fixing mechanism.

10. The dehumidifier according to claim 7, wherein the fixing mechanism is formed on one of the filter case and the filter frame; and the fixing hook is formed on the other of the filter case and the filter frame, the hook being interlocked with the fixing mechanism.

11. The dehumidifier according to claim 10, wherein the housing comprises an outer housing provided with a hole in which the fixing hook is inserted and an inner housing connected to the outer housing by a hinge; and a spring interposed between the outer housing and the inner housing for the mutual support.

12. The dehumidifier according to claim 10, wherein the elastic member is vertically inclined.

13. The dehumidifier according to claim 10, further comprising a torsion spring for returning the cam from a rotated position to an initial position.

14. The dehumidifier according to claim 10, wherein the cam comprises:

a body provided with a hook groove on which the fixing hook is hooked;

a pin connected to the housing after passing through the body, the pin defining a rotational center of the body; and a guide portion protruding from an outer circumference of the body for the hook operation with the lever.

15. The dehumidifier according to claim 14, wherein the guide portion comprises:

a hook end on which the lever is hooked;

a hook fixing inclined surface for guiding the lever to the hook end; and a return inclined surface formed continuously from the hook end to the outer circumference of the cam for the release of the lever hooked on the hook end.

16. A dehumidifier comprising:

a cabinet provided with an air inlet and an air outlet;

a front panel assembly defining an outer appearance of the cabinet and pivoting frontward of the cabinet;

a filter for purifying air introduced through the air inlet;

a filter case for receiving the filter;

a filter frame to which the filter case is pivotally coupled; and a mounting/dismounting mechanism for coupling or separating the filter case to or from the filter frame, wherein the mounting/dismounting mechanism comprises: a fixing hook formed on one of the filter frame and the filter case; and a fixing mechanism formed on the other of the filter case and the filter frame for the hook operation with the fixing hook, wherein the fixing mechanism comprises: a housing defining an outer appearance; a cam installed in the housing and rotating by a predetermined angle by an interference with the fixing hook; a lever installed in the housing and hooked on the cam rotating by the interference with the fixing hook; and an elastic member disposed between the lever and the housing and biasing the lever toward the cam.

* * * * *